United States Patent [19]

Hebert et al.

[11] Patent Number: 4,909,320

[45] Date of Patent: Mar. 20, 1990

[54] DETONATION ASSEMBLY FOR EXPLOSIVE WELLHEAD SEVERING SYSTEM

[75] Inventors: Joseph V. Hebert; Robert J. Schwartz, both of Houston, Tex.

[73] Assignee: Drilex Systems, Inc., Houston, Tex.

[21] Appl. No.: 258,228

[22] Filed: Oct. 14, 1988

[51] Int. Cl.[4] ..... E21B 29/02; E21B 29/12

[52] U.S. Cl. ..... 166/55.1; 166/65.1; 166/361; 166/376; 439/181

[58] Field of Search ..... 166/55, 55.1, 63, 65.1, 166/297, 299, 361, 376; 175/4.54, 4.56; 102/318, 322; 439/181

[56] References Cited

U.S. PATENT DOCUMENTS

| | | | |
|---|---|---|---|
| 2,202,887 | 6/1940 | Aloi . | |
| 2,390,676 | 12/1944 | Alexander | 102/20 |
| 2,427,377 | 9/1947 | Zschokke | 166/1 |
| 2,530,966 | 11/1950 | Huber | 166/5 |
| 2,620,029 | 12/1952 | Turechek et al. | 164/0.5 |
| 2,697,212 | 12/1954 | Castelli | 439/181 |
| 2,911,909 | 11/1959 | Fuchs | 102/20 |
| 3,032,110 | 9/5196 | Hanes et al. | 166/63 |
| 3,183,972 | 5/1965 | Fredd | 166/35 |
| 3,331,321 | 7/1987 | Kirby, III | 102/20 |
| 3,976,347 | 8/1976 | Cooke, Sr. et al. | 166/65.1 |
| 4,266,613 | 5/1981 | Boop | 166/63 |
| 4,544,035 | 10/1985 | Voss | 166/299 |
| 4,574,892 | 3/1986 | Grigar et al. | 175/4.51 |
| 4,611,660 | 9/1986 | Stout et al. . | |
| 4,673,033 | 6/1987 | Minear et al. | 166/55.1 |
| 4,690,218 | 9/1987 | Sumner | 166/297 |

*Primary Examiner*—Jerome W. Massie, IV
*Assistant Examiner*—Terry Lee Melius
*Attorney, Agent, or Firm*—Edgar A. Zarins; Malcolm L. Sutherland

[57] ABSTRACT

A detonation assembly for an explosive wellhead severing system which employs a battery pack lowerable through a drill string to engage and power the detonation assembly positioned within the well bore. The lowerable unit includes a biased shutter which seals the contacts from discharge of the battery pack by the surrounding fluids. The shuttered unit is lowered into contact with the receiving unit to arm the detonation assembly. Until the power unit is lowered into engagement, the severing system is not armed. In case of malfunction or misfire, the power unit can be retrieved to disarm the detonator assembly. The entire assembly is housed within the drill string to isolate the critical elements from the surrounding environment.

37 Claims, 3 Drawing Sheets

DETONATION ASSEMBLY FOR EXPLOSIVE WELLHEAD SEVERING SYSTEM

BACKGROUND OF THE INVENTION

I. Field of the Invention

This invention relates to a detonation assembly for the severing of a wellhead and, in particular, to a connector assembly to supply the firing voltage to the detonator assembly which is selectively engageable to control arming of the explosive and which seals the contact elements to prevent discharge of the power unit prior to engagement for detonation.

II. Description of the Prior Art

Explosives are widely used in drilling operations for the perforation of well casings and the severing of subsea wellheads for their removal. The safe operation of these explosive assemblies is of utmost importance. Potentially armed explosive tools are avoided to ensure detonation only when the device is properly positioned. Most modern explosive devices are triggered by a detonator operated by an electrical charge. Such a charge can be supplied either from the surface or through a separate power unit which is lowered into the hole. The surface detonated devices provide the advantage that detonation can be directly controlled. However, such surface detonated devices require extensive wiring in deep wells and may provide no means of absolutely disarming the explosive in the event of a malfunction. The lowerable units depend upon a battery pack which may become discharged because of the fluid environment.

In one type of previously devised system, after the explosive is positioned, a drop bar is placed in the pipe to travel through the pipe for contact with a firing piece. However, because the explosive is placed in a firing state at the surface before lowering into the well inadvertent firing of the explosive can occur. Moreover, because the drop bar travels in an essentially uncontrolled manner down the pipe it may become lodged in the pipe. In order to correct the problem, the explosive would have to be retrieved from the well which could dislodge the drop bar resulting in detonation at an undesired location, possibly near the surface rig.

Systems which are detonated by a surface operator have proven to be time consuming and expensive. As the drill string is lowered to lower the explosive, successive lengths of pipe are added and the conducting cable is reeled off and attached to the drill pipe. The attachment and retrieval of the cable can be time consuming. Moreover, because the cable is attached to the exterior of the pipe, severing of the cable as the pipe is lowered into the casing is not unknown. Although costly, the system is relatively safe since no power is applied until a specific sequence is conducted by a surface operator.

Other systems have been developed which utilize a lowerable battery or power module to charge the detonator. The explosive charge is positioned within the well. Thereafter, the power unit is lowered into mating engagement with the receiving module and detonation occurs upon contact. Although such devices operate well in dry environments, the highly conductive properties of sea water make such devices unsuitable for subsea operations since the battery pack will likely be discharged prior to engagement. Power units which utilize insulated contacts have been developed but require that the insulation be stripped away to complete the circuit. If the contact does not precisely engage the stripper elements the explosive will not be detonated.

SUMMARY OF THE PRESENT INVENTION

The present invention overcomes the disadvantages of the prior known detonation assemblies by providing a mechanism which is unarmed until the power unit is lowered into conductive contact. The contacts of the power unit are sealed from the surrounding fluid environment to prevent discharge of the battery prior to contact.

The detonation assembly of the present invention includes a firing module and detonator assembly which are lowered with a drill string into the well and positioned appropriately. The firing module is mounted in a shock absorbant pressure protected cavity below the connector to protect the module from exterior damage and provide unlimited operating depth. The firing module is connected to the explosive by a high voltage cable which runs through the string to prevent damage or severing. A low voltage line extends between the firing module and the male connector which includes a conductive contact. The downhole connector includes guides to direct the lowered unit into contact with the male connector.

Once the explosive is positioned the power pack connector can be lowered to detonate the explosive. The unit is lowered on a wireline through the drill string into contact with the male connector. The lowerable unit preferably includes a battery pack to energize the firing module. The battery pack is connected to a shuttered contact element designed to mate with and establish an electrical connection with the male connector. The contact is annular and forms part of an axial cylinder. A spring biased piston or sleeve is disposed within the cylinder. As the unit is being lowered, the piston or sleeve is biased to sealingly cover the contact element. This piston/sleeve includes a series of sealing elements which prevent the sea water from completing the circuit and discharging the battery prior to engagement with the downhole connector. As the power unit is lowered onto the male connector, the piston/sleeve is pushed out of engagement with the contact. Upon engagement of the power unit contact with the contact on the male connector, the firing module is fired to detonate the explosive. In the event of a malfunction or simply following detonation, the battery pack can be retrieved using the wireline which disarms the detonation assembly.

The present invention can be used in any operation involving the detonation of explosives. In addition to the severing of a wellhead for its removal, the detonator connector may be used in perforating operations, platform leg severing, drill collar severing, and sidetracking through set casing. Furthermore, the connector apparatus of the present invention could be used as an electrical connector for the transfer of information from the memory of a recording sensor positioned in the hole such as a free-standing MWD system.

Other objects, features and advantages of the present invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
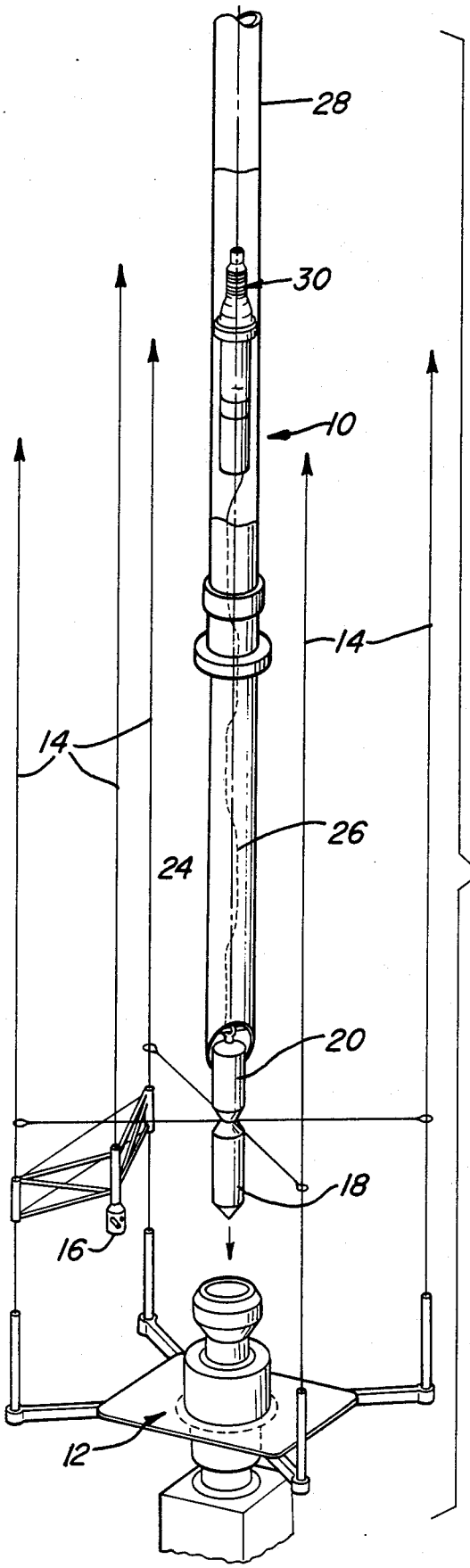
FIG. 1 is a perspective view of the explosive wellhead severing system embodying the present invention being lowered into a subsea wellhead.
Figure 2:
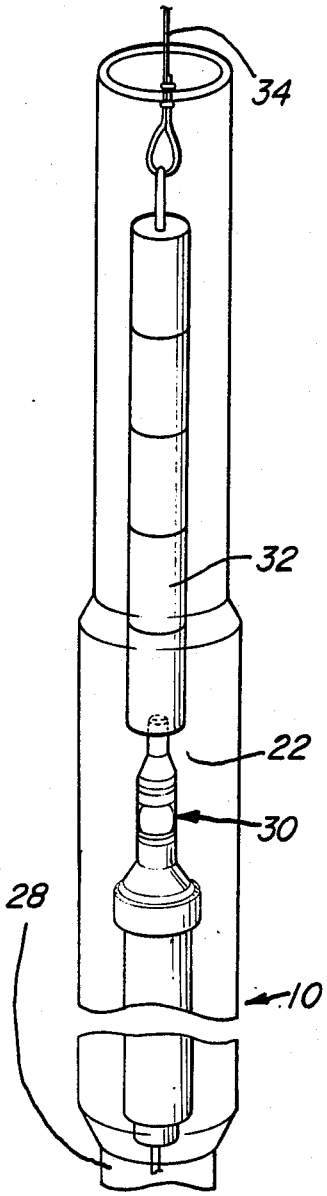
FIG. 2 is an enlarged perspective of the detonation assembly embodying the present invention within a drill string.
Figure 2:
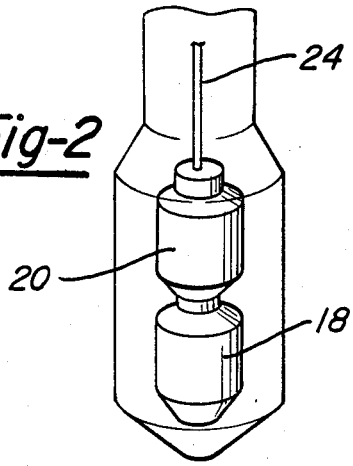
Figure 3:
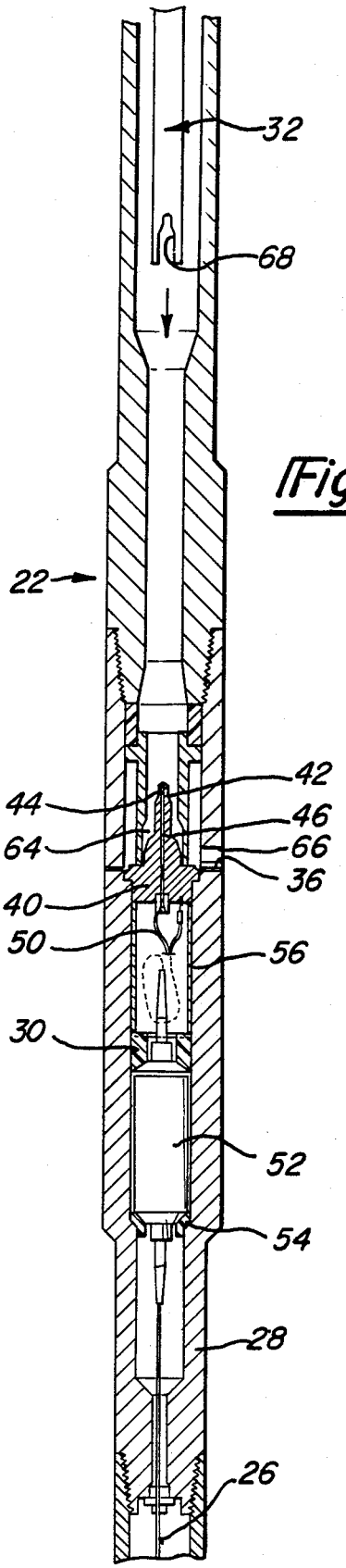
FIG. 3 is a cross-sectional perspective of the detonation assembly prior to connection.
Figure 4:
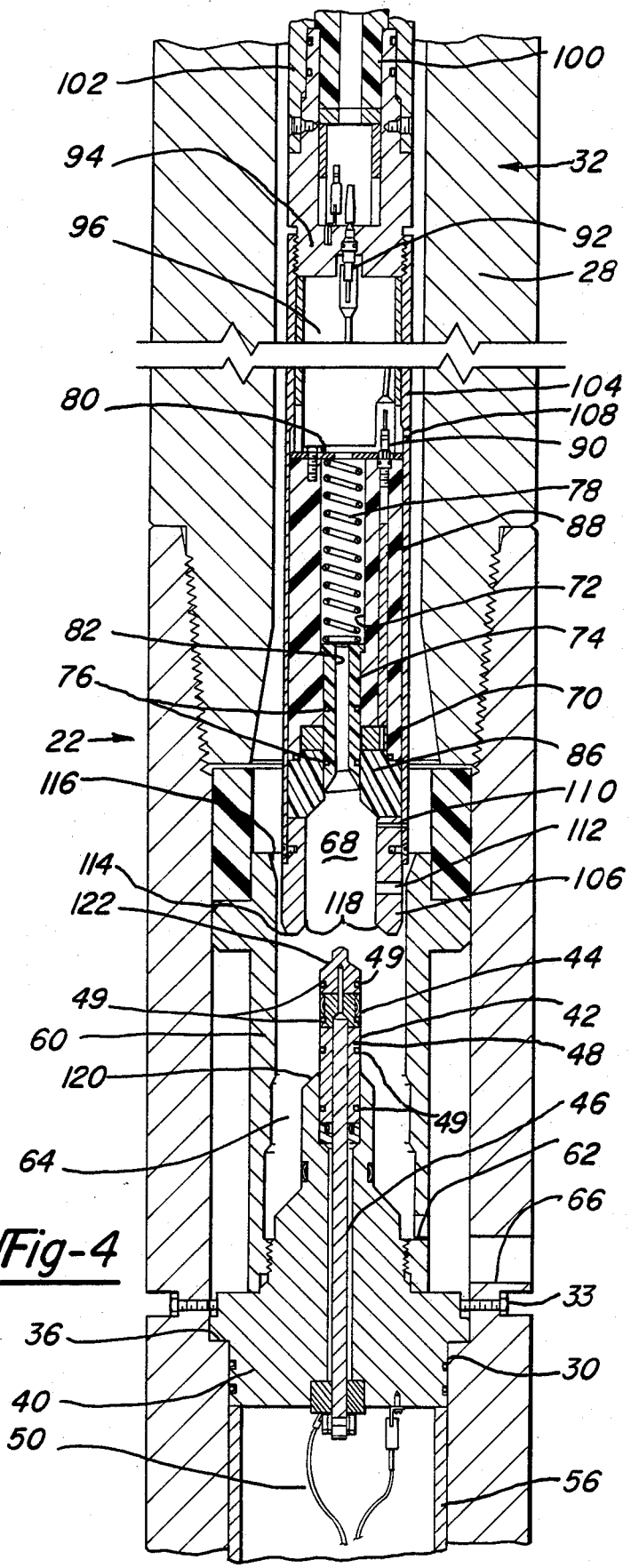
FIG. 4 is an enlarged cross-sectional perspective of the connector units prior to connection for detonation.
Figure 5:
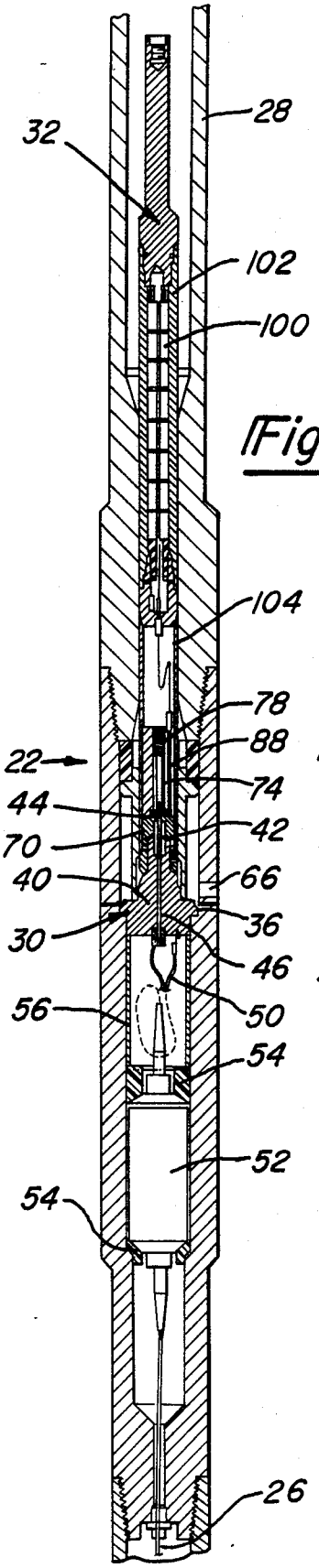
FIG. 5 is a cross-sectional perspective of the detonation assembly in full connection.

Referring first to FIGS. 1 and 2, there is shown a wellhead severing system 10 for severing a wellhead 12 below the surface to facilitate removal of the wellhead 12. In a preferred embodiment, the wellhead 12 is situated on the ocean floor and connected to the surface rig by a plurality of guide lines 14. A camera 16 may be provided to monitor the insertion of production tools or the severing system 10 of the present invention into the wellhead 12. According to regulations governing subsea exploration for gas and oil, the wellhead 12 from non-producing subsea wells must be severed and removed so as not to create a hazard to navigation. The severing system 10 of the present invention ensures accurate and reliable severing of the well casing in order to allow removal of the wellhead 12.

The severing system 10 embodying the present invention includes an explosive charge 18 of sufficient strength to explode through the layers of casing which may be positioned below the wellhead 12. A ballast container 20 is positioned axially above the charge 18 to inhibit the explosion from traveling upwardly. In one embodiment, the ballast 20 and charge 18 are connected to the bottom end of a detonating connector apparatus 22 embodying the present invention. The connector apparatus 22 may be connected by a wireline 24 with a high voltage line 26 mounted thereto and extending between the detonating connector apparatus 22 and the charge 18. In a preferred embodiment, the detonating connector apparatus 22, ballast 20 and charge 18 are positioned within a drill string 28 which is lowered into the wellhead 12 and positioned for optimum severing of the casing. The camera 16 may be utilized to monitor insertion of the drill string 28 into the wellhead 12. Preferably, the detonating connector apparatus 22 comprises a fixed connector 30 positioned within the string 28 and a connector 32 which can be lowered or dropped into mating engagement with the fixed connector 30. The lowerable connector 32 can be run into the string 28 by a wireline 34 as shown in FIG. 2, pumped down the string 28 into mating engagement, or dropped down the string 28 into mating engagement.

Referring to FIGS. 3 through 6 which show the detonating connector apparatus 22 in the unengaged and the engaged positions. The lower connector 30 is fixedly but removably positioned within the drill string 28. The fixed connector 30 is seated on an annular shoulder 36 of the string 28 and held in place by a plurality of retaining screws 38. The connector 30 includes a pressure head 40 having a male projection 42 with an electrical contact 44 formed on the male projection 42. Electrical conducting means in the form of a rod 46 extends from the contact 44 through the pressure head 40. An insulating sleeve 48 is positioned proximate the electrical contact 44 to insulate the contact 44 from the pressure head 40 and the remainder of the apparatus 22 such that the electrical charge is directed through the rod 46 to the wire 50. In addition, the male projection 42 is provided with a series of longitudinally spaced O-ring seals 49 which will sequentially isolate the contact of the lowerable connector 32 to prevent discharge until full engagement is accomplished as will be subsequently described. The wire 50 runs to a firing assembly 52 positioned within a shock-absorbing cavity of the drill string 28. The firing assembly 52 is cushioned by rubber absorbers 54. A spacer sleeve 56 is disposed between the pressure head 40 and cushioning member 54 of the firing assembly 52. The firing assembly 52 is a DC-DC converter which transforms the low voltage charge supplied through the apparatus 22 into a high voltage charge for detonation of the explosive charge 18. An example of such a firing assembly 52 is the FS-40 subsurface firing pulse generator manufactured by Reynolds Industries. The high voltage line 26 connects the FS-40 to the explosive charge 18.

The fixed connector 30 is provided with a guide sleeve 60 to guide the mating engagement of the fixed connector 30 and the lowerable connector 32 as will be subsequently described. The guide sleeve 60 is threadably connected to the pressure head 40 and includes a fluid port 62 to permit fluid flow from the annulus 64 formed between the male projection 42 and the guide sleeve 60. An additional port 66 may be provided in the drill string 28 to allow fluid flow to the exterior of the string 28. The ports 62 and 66 will also provide some hydraulic cushioning as the connector apparatus 22 is brought into mating engagement.

Figure 6:
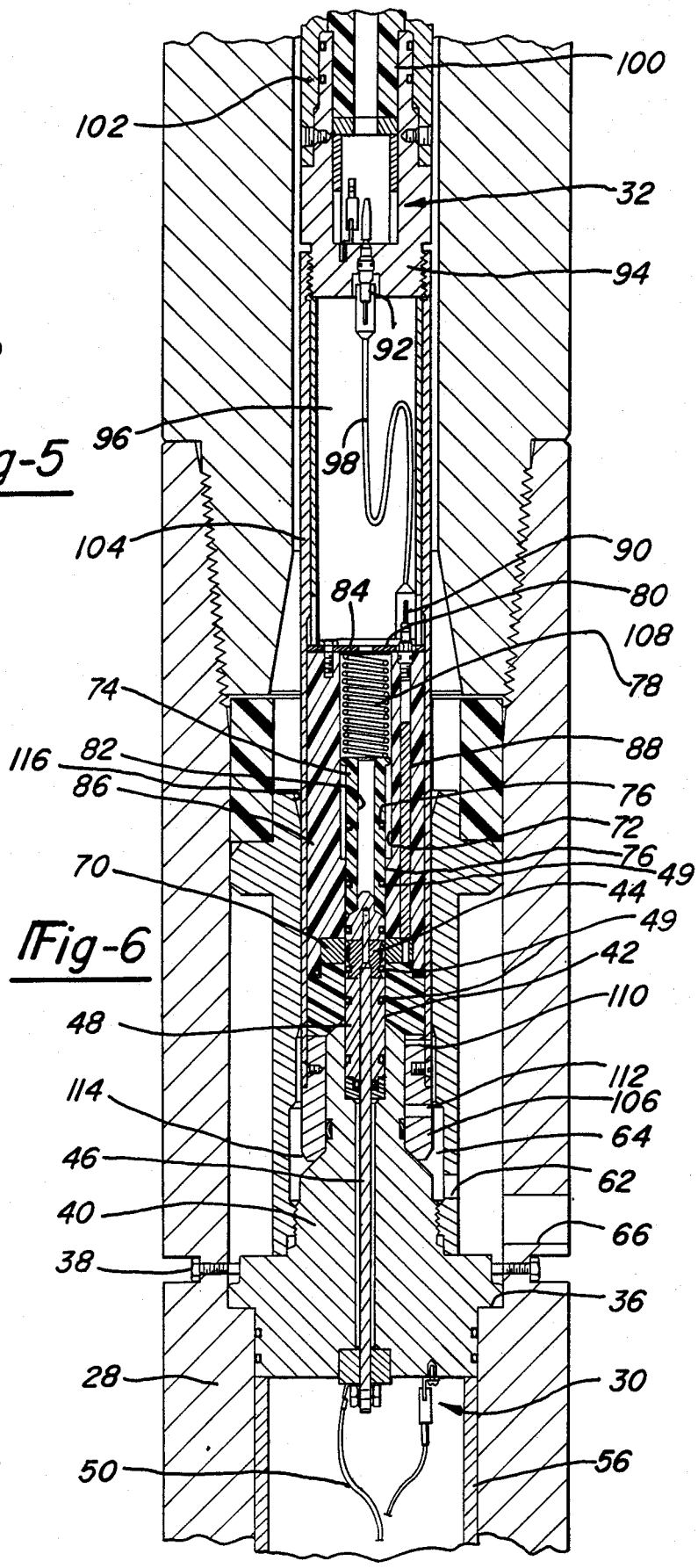
FIG. 6 is an enlarged cross-sectional perspective of the connector units in full contact for detonation.

In a preferred embodiment of the present invention, the connector 32 is lowerable through the drill string 28 into engagement with the fixed connector 30 to detonate the explosive charge 18 as will be subsequently described. The lowerable connector 30 includes a female receptacle 68 configured to matingly engage the male projection 42 of the fixed connector 30. The female receptacle 68 of the connector 32 has an electrical contact 70 disposed therein for engagement with the contact 44 of the male projection 42. The female receptacle 68 includes a cylindrical portion 72 within which the contact 70 is disposed. A retractable piston or sleeve 74 is movably disposed within the cylinder 72 for selective sealing isolation of the contact 70. The piston 74 is movable between a first position wherein the piston 74 sealingly covers the contact 70 (FIG. 4) and a second position exposing the contact 70 (FIG. 6). The piston 74 is provided with 0-ring seals 76 to sealingly isolate the contact 70. At least one seal 76 is disposed above and below the contact 70 when the piston 74 is in its first isolating position in order to prevent the surrounding sea water from completing a conducting path for the electrical contact 70 thereby discharging the power source. The piston 74 is biased towards the first position by a spring 78 disposed within the cylinder 72 and compressible between the piston 74 and an end wall 80 of the cylinder 72. The piston 74 is provided with a throughbore 82 and the end wall 80 has an aperture 84 to allow fluid to flow from the cylinder 72 during engagement as will be subsequently described.

The contact 70 of the lowerable connector 32 is surrounded by insulating material 86 to isolate the contact 70. The piston 74 is also preferably made of an insulating material to prevent electrical conduction except through the contact 44 of the fixed connector 30. Second electrical conducting means in the form of a conducting rod 88 extend through the insulating material 86 between the contact 70 and a feedthru plug 90 mounted in the end wall 80. A second feedthru plug 92 is mounted within opposite end wall 94 of fluid chamber 96. A connecting wire 98 extends between the plugs 90 and 92. The plug 92 is electrically connected to an energy source utilized to trigger the firing module 52 and detonate the explosive charge 18. In a preferred embodiment, the energy source is a battery pack 100 sealed within a sub 102 of the lowerable connector 32 to prevent seawater from discharging the battery pack 100. Alternatively, the energy source may be at the surface with a conducting line extending along the wireline 34 for connection with the connector 32.

Threadably connected to the lower end of the battery pack sub is an external sleeve 104 of the lowerable connector 32 which encloses and retains the female receptacle 68 and contact 70. Attached to the lower end of the external sleeve 104 is a landing ring 106 which forms the opening to the female receptacle 68 and cooperates with the fixed connector 30 to guide the connectors into engagement as will be subsequently described. The external sleeve 104 and landing ring 106 have a number of fluid ports which allow the seawater to flow from the interior of the detonating connector apparatus 22 during engagement while also cushioning the mating engagement by limiting flow through the ports. An upper port 108 formed in the sleeve 104 above the end wall 90 to allow fluid communication between the chamber 96 and the exterior of the lowerable connector 32. In a preferred embodiment, the aperture 84 formed in the end wall 80 has a greater area than the port 108 such that seawater will flow into the chamber 96 as the male projection 42 engages the female receptacle 68 yet less fluid will be allowed to flow through port 108 thereby creating a cushioning effect as the connectors 30 and 32 matingly engage. Similarly, the landing ring 106 is provided with an upper port 110 and a lower port 112 to form additional cushioning means by limiting the exhaust flow of fluid from the female receptacle 68 during mating engagement. Preferably, the upper exhaust port 110 of the landing ring 106 has a smaller area than the lower exhaust port 112 such that as the connectors initially engage fluid will flow through both ports 110 and 112 and as engagement is advanced the larger, lower port 112 will be covered causing the upper port 110 to exhaust the majority of fluid from the female receptacle 68 creating a hydraulic cushion. The outlets 62 and 66 also provide some hydraulic cushioning as the connectors matingly engage.

Several cooperating guide means are provided on the fixed connector 30 and the lowerable connector 32 to progressively guide the male projection 42 into engagement with the female receptacle 68. Initial guidance is accomplished by the drill string 28 surrounding the lowerable connector 32. However, as the lowerable connector 32 approaches the fixed connector 30, the outside bevelled edge 114 of the landing ring 106 will engage the inside bevelled edge 116 of the guide sleeve 60 to further align the lowerable connector 32. As engagement continues, the inside bevelled edge 118 of the landing ring 106 will engage sloped surface 120 of the male projection 42. Final alignment will occur as the tip end 122 of the male projection 42 enters the cylinder 72 of the female receptacle 68. Thus, the connectors 30 and 32 will gradually become aligned to ensure proper engagement of the contact 44 and 70.

Operation of the present invention ensures safe detonation of an explosive charge to sever a wellhead yet provides for absolute disarming of the detonation apparatus in the event of a malfunction which does not detonate the charge. Accordingly, the charge can be retrieved without fear of accidental detonation as the charge is raised to the rig. Furthermore, the lowerable battery pack is prevented from discharging even in seawater by the insulating piston which isolates the conductors until the connection is made to ensure sufficient energy to detonate the charge. Operation also reduces operating time and cost by permitting rapid deployment by eliminating the handling problems of prior known systems and allowing greater operating depth.

Referring to FIG. 1 to sever the wellhead 12 and remove it from the ocean floor, the severing system 10 of the present invention is lowered, such as by guide lines 14, into the wellhead 12 until the explosive charge 18 is positioned as desired below the wellhead 12. The severing system 10 incorporating the charge 18, ballast 20 and fixed connector 30 are lowered with the drill string 28. With the charge 18 positioned and the fixed connector 30 situated within the drill string 28, the lowerable connector 32 can now be lowered through the drill string 28. Until the lowerable connector 32 fully engages the fixed connector 30 seated within the drill string 28, the charge 18 cannot be detonated. The lowerable connector 32 can be run into the drill string 28 by wireline 34 as shown in FIG. 2. In the event the wireline breaks the connector 32 can be fished out of the string using conventional tools. Alternatively, the connector 32 can be pumped down or dropped down the string 28 since the energy source is incorporated into the connector 28.

Referring now to FIGS. 3 through 6, the lowerable connector 32 is run down the string 28 to approach the fixed connector 30 seated within the string 28. As the connectors close, initial contact will be made between the inside bevelled edge 116 of the guide sleeve 60 and the outside bevelled edge 114 of the landing ring !06 to align the outer circumference of the lowerable connector 32 with the guide sleeve 60. Further travel of the lowerable connector 32 will cause inside edge 118 of the landing ring 106 to engage shoulder 120 of the male projection 42 causing the male projection 42 to extend into the female receptacle 68 of the lowerable connector 32. Additional lowering of connector 32 will cause sloped end shoulder 122 to align with and extend into the cylinder 72 resulting in mating engagement of the connectors.

During mating engagement of the connectors as described above, the fluid trapped between the connectors will be forced out through the various fluid ports formed in the connectors and the drill string 28. Initial fluid exhaust will occur through the bore 82, aperture 84 and upper port 108 as the connector 32 is lowered through the drill string 28 and through ports 62 and 66 as the connector 32 enters the guide sleeve 60. Because of the restricted flow area of these openings, a hydraulic cushioning effect will be created to prevent any damage as the connectors engage. As the male projection 42 matingly engages the female receptacle 68, ports 112 and 110 will exhaust fluid from the female receptacle 68.

As the male projection 42 enters the cylinder 72 it will engage the piston 74 which is spring-biased toward the projection 42 to sealingly insulate the contact 70 of the female receptacle 68. The seals 76 on the piston 74 seal opposing ends of the contact 70 to prevent seawater from forming a conducting electrical path which would discharge the energy source. The male projection 42 will move the piston 74 from its first position (FIG. 4) towards its second position (FIG. 6). The seals 49 on the male projection 42 will sealingly engage the cylinder 72. The longitudinal spacing of the seals 49 and 76 is such that the contact 70 of the female receptacle 68 will be between pairs of seals thereby sequentially and continuously isolating the contact 70 to prevent discharge. Eventually when the connectors become fully engaged the contact 44 of the male projection 42 will engage the contact 70 of the female receptacle 68 to complete the circuit between the energy source and the firing module 52. Within a few seconds of engagement of the contacts 44 and 70, the low voltage energy from the battery pack 100 will be conducted to the firing module 52 which will generate the high voltage pulse to detonate the explosive charge 18. In the case of a misfire or malfunction, the lowerable connector 32 is simply retrieved from the drill string 28 to disarm the charge 18 at which point the entire string 28 can be retrieved to correct the malfunction without endangering rig personnel. Several of the firing modules, such as the FS-40, include internal circuitry which will discharge any insufficient charge not great enough to create the detonating pulse thereby ensuring complete disarment.

Thus, the present invention provides an inherently safe and reliable method and an apparatus for detonating an explosive charge disposed in a well for severing and removal of the wellhead.

The foregoing detailed description has been given for clearness of understanding only and no unnecessary limitations should be understood therefrom as some modifications will be obvious to those skilled in the art without departing from the scope and spirit of the appended claims.

We claim:

1. An apparatus for detonating an explosive charge using a firing assembly, said apparatus comprising:

a fixed connector having an electrical contact and first conducting means electrically connecting said contact to the firing assembly and the explosive charge;

a lowerable connector having an electrical energy source, an electrical contact and second conducting means electrically connecting said energy source to said contact, and retractable means movable between a first and second position for electrically isolating said electrical contact of said lowerable connector to prevent discharge of said electrical energy source said retractable means being biased toward said first position;

said lowerable connector movable into detachable mating engagement with said fixed connector to engage said electrical contacts thereby electrically connecting said energy source to the firing assembly and explosive charge, said isolating means retracting to expose said electrical contact of said lowerable connector as said lowerable connector engages said fixed connector and said lowerable connector being detachable from said fixed connector to disconnect said energy source from the firing assembly to disarm the explosive charge.

2. The detonating apparatus as defined in claim 1 wherein said electrical contact of said fixed connector is mounted to a male projection and said electrical contact of said lowerable connector is disposed within a female receptacle, said male projection extending into said female receptacle as said lowerable connector moves into mating engagement with said fixed connector to engage said electrical contacts.

3. The detonating apparatus as defined in claim 2 wherein said female receptacle of said lowerable connector includes a substantially tubular cylinder, said electrical contact of said lowerable connector disposed within said cylinder.

4. The detonating apparatus as defined in claim 3 wherein said isolating means comprises a retractable piston movably positioned in said cylinder, said piston movable between a first position sealingly isolating said electrical contact of said lowerable connector and a second position exposing said contact for engagement by said contact of said fixed connector.

5. The detonating apparatus as defined in claim 4 wherein said piston is biased within said cylinder towards said first isolating position to return said piston to said first position upon disconnection of said fixed and lowerable connectors.

6. The detonating apparatus as defined in claim 5 wherein said piston is biased by a compression spring positioned within said cylinder between said piston and an end wall of said cylinder.

7. The detonating apparatus as defined in claim 4 wherein said fixed connector includes first guide means engageable with said lowerable connector to guide said female receptacle into alignment with said male projection.

8. The detonating apparatus as defined in claim 7 wherein said fixed connector includes second guide means engageable with said lowerable connector to guide said female receptacle into alignment with said male projection.

9. The detonating apparatus as defined in claim 8 wherein said fixed connector includes third guide means engageable with said lowerable connector to guide said female receptacle into alignment with said male projection, said third guide means formed at the remote end of said male projection to engage said female receptacle.

10. The detonating apparatus as defined in claim 2 wherein said lowerable connector includes first means for cushioning the mating engagement of said connectors, said first cushioning means comprising at least one lateral port formed in said lowerable connector, said at least one port providing fluid communication between said female receptacle and the exterior of said lowerable connector.

11. The detonating apparatus as defined in claim 6 wherein said lowerable connector includes second means for cushioning the mating engagement of said connectors, said second cushioning means comprising at least one aperture in said end wall of said cylinder and at least one lateral port formed in said lowerable connector above said end wall of said cylinder.

12. The detonating apparatus as defined in claim 11 wherein said at least one aperture has a larger diameter than said at least one lateral port.

13. The detonating apparatus as defined in claim 1 wherein said electrical energy source comprises a battery pack housed within said lowerable connector, said second conducting means electrically connecting said battery pack to said contact of said lowerable connector.

14. The detonating apparatus as defined in claim 1 wherein said fixed connector is positionally captured within a well string, the firing assembly mounted within a shock-absorbing cavity of said well string below said fixed connector.

15. The detonating apparatus as defined in claim 14 wherein said lowerable connector is lowered through said well string for engagement with said fixed connector.

16. The detonating apparatus as defined in claim 15 wherein said lowerable connector is lowered by wireline into said well string.

17. The detonating apparatus as defined in claim 15 wherein said lowerable connector is pumped down through said well string into engagement with said fixed connector.

18. The detonating apparatus as defined in claim 15 wherein said lowerable connector is dropped down through said well string into engagement with said fixed connector.

19. An apparatus for detonating an explosive charge positioned in a well bore using a firing assembly, said apparatus comprising:

a fixed connector positionally captured within a well string extending into the well bore, said fixed connector having a first electrical contact and first conducting means electrically connecting said first contact to the firing assembly and the explosive charge;

a lowerable connector movable through said well string into mating engagement with said fixed connector, said lowerable connector having an electrical energy source, a second electrical contact and second conducting means electrically connecting said energy source to said second contact; and retractable shutter means for sealingly electrically isolating said second electrical contact of said lowerable connector from the surrounding fluid environment to prevent discharge of said electrical energy source, said retractable shutter means longitudinally movable between a first position sealingly isolating said second electrical contact and a second position exposing said second electrical contact, said retractable shutter means biased towards said first position;

said lowerable connector movable into mating engagement with said fixed connector moving said retractable shutter means longitudinally from said first position to said second position to engage said first and second electrical contracts thereby electrically connecting said energy source to the firing assembly detonating the explosive charge.

20. The detonating apparatus as defined in claim 19 wherein said lowerable connector is lowered through said well string into mating engagement with said fixed connector by a wireline.

21. The detonating apparatus as defined in claim 19 wherein said lowerable connector is pumped through said well string into mating engagement with said fixed connector.

22. The detonating apparatus as defined in claim 19 wherein said first electrical contact of said fixed connector is mounted to a male projection and said second electrical contact of said lowerable connector is mounted within a female receptacle, said male projection extending into said female receptacle as said lowerable connector moves into mating engagement with said fixed connector to engage said first and second electrical contacts, said male projection engaging and moving said retractable means from said first position towards said second position as said connectors matingly engage.

23. The detonating apparatus as defined in claim 22 wherein said female receptacle includes a substantially tubular cylinder, said second contact disposed within said cylinder, said retractable shutter means comprising a spring-biased piston movably disposed within said cylinder and sealingly engaging said cylinder.

24. The detonating apparatus as defined in claim 23 wherein said piston and said male projection include a plurality of longitudinally spaced isolating seals, said second conductor being sequentially sealingly isolated between pairs of said seals as said male projection matingly engages said female receptacle to prevent electrical discharge of said energy source.

25. The detonating apparatus as defined in claim 23 and further comprising means for guiding said female receptacle into alignment with said male projection as said lowerable connector matingly engages said fixed connector.

26. The detonating apparatus as defined in claim 23 and further comprising hydraulic cushion means for cushioning the mating engagement of said connectors.

27. The detonating apparatus as defined in claim 19 wherein said electrical energy source comprises a battery pack housed within said lowerable connector.

28. The detonating apparatus as defined in claim 19 wherein said electrical energy source comprises a power line extending to a surface power unit.

29. An apparatus for detonating an explosive charge positioned in a well bore using a firing assembly, said apparatus comprising:

a fixed connector positionally captured within a well string extending into the well bore, said fixed connector having a first electrical contact formed on a male projection and first conducting means electrically connecting said first contact to said firing assembly, said firing assembly mounted within a shock absorbing cavity of said well string below said fixed connector;

a lowerable connector movable through said well string into mating engagement with said fixed connector, said lowerable connector having a female receptacle with a second electrical contact disposed therein, an electrical energy source, and second conducting means electrically connecting said energy source to said second contact; and retractable means for sealingly electrically isolating said second electrical contact from the surrounding fluid environment to prevent discharge of said electrical energy source, said retractable means comprising a spring-biased piston movably disposed within said female receptacle between a first position sealingly isolating said second electrical contact and a second position exposing said second electrical contact, said retractable means biased towards said first position;

said lowerable connector movable into mating engagement with said fixed connector, said male projection extending into said female receptacle moving said retractable means from said first position to engage said first and second contacts thereby electrically connecting said energy source to the firing assembly thereby detonating the explosive charge.

30. The detonating apparatus as defined in claim 29 wherein said piston includes a plurality of longitudinally spaced isolating seals, said second contact disposed between pairs of said seals when said piston is in said first position to sealingly isolate said second contact.

31. The detonating apparatus as defined in claim 29 and further comprising means for guiding said female receptacle into alignment with said male projection as said lowerable connector matingly engages said fixed connector.

32. The detonating apparatus as defined in claim 29 and further comprising hydraulic cushion means for cushioning the mating engagement of said connectors.

33. A connector assembly for completing a conductive path between a first apparatus and a second apparatus, said connector assembly comprising:

a fixed connector positionally captured within a wall string, said fixed connector having a first electrical contact and first conducting means electrically connecting said contact to the first apparatus;

a lowerable connector movable through said well string into mating engagement with said fixed connector, said lowerable connector having a second electrical contact and second conducting means electrically connecting said contact to the second apparatus;

retractable means for electrically isolating said electrical contact of said lowerable connector from the surrounding fluid environment, said retractable means comprising a retractable sleeve movable between a first position sealingly isolating said second electrical contact and a second position exposing said second electrical contact, said retractable means biased towards said first position;

said lowerable connector movable into mating engagement with said fixed connector to engage said electrical contacts thereby establishing an electrical path between the first and second apparatus, said isolating means retracting to expose said electrical contact of said lowerable connector as said lowerable connector engages said fixed connector.

34. The connector assembly as defined in claim 33 wherein said retractable sleeve includes a plurality of isolating seals to sealingly isolate said second electrical contact.

35. The connector assembly as defined in claim 34 wherein said electrical contact of said fixed connector is mounted to a male projection and said electrical contact of said lowerable connector is disposed within a female receptacle, said male projection extending into said female receptacle as said lowerable connector moves into mating engagement with said fixed connector to engage said electrical contacts.

36. The connector assembly as defined in claim 35 wherein said retractable sleeve is movably disposed within said female receptacle to selectively isolate said second electrical contact, said sleeve retracting to expose said second electrical contact as said male projection matingly engages said female receptacle.

37. A method for detonating an explosive charge within a well bore to sever a subsea wellhead comprising:

positioning a first connector within the well bore, said first connector having a first electrical contact and first conducting means electrically connecting said first contact to a firing assembly for detonating the explosive charge;

lowering a second connector into the well bore for mating engagement with said first connector, said second connector including an electrical energy source, a second electrical contact and second conducting means electrically connecting said energy source to said second contract, said second connector having longitudinally retractable shutter means movable between a first and second position and biased toward said first position for electrically isolating said second electrical contact to prevent discharge of said electrical energy source;

retracting said shutter means as said first and second connector matingly engage to expose said second electrical contact;

engaging said first and second contacts as said shutter means retracts thereby electrically connecting said energy source to the firing assembly;

detonating the explosive charge to sever the wellhead; and removing the wellhead from the sea floor.

* * * * *